US012589902B2

(12) United States Patent
Morijiri et al.

(10) Patent No.: US 12,589,902 B2
(45) Date of Patent: Mar. 31, 2026

(54) FEEDING SPEED CONTROL FOR A BINDING MACHINE

(71) Applicant: MAX CO., LTD., Tokyo (JP)

(72) Inventors: Takeshi Morijiri, Tokyo (JP); Takahiro Ito, Tokyo (JP)

(73) Assignee: Max Co., Ltd., Tokyo (JP)

( * ) Notice: Subject to any disclaimer, the term of this patent is extended or adjusted under 35 U.S.C. 154(b) by 199 days.

(21) Appl. No.: 18/238,803

(22) Filed: Aug. 28, 2023

(65) Prior Publication Data

US 2024/0075517 A1 Mar. 7, 2024

(30) Foreign Application Priority Data

Sep. 2, 2022 (JP) ..... 2022-139996

(51) Int. Cl.
*B65B 27/10* (2006.01)
*E04G 21/12* (2006.01)

(52) U.S. Cl.
CPC ..... *B65B 27/10* (2013.01); *E04G 21/123* (2013.01)

(58) Field of Classification Search
CPC ..... B21F 15/00; B21F 15/02; B21F 15/04; B21F 7/00; B65B 13/22; B65B 13/28; B65B 13/285; B65B 13/025; B65B 13/04; B65B 13/06; B65B 27/10; B25B 25/00; E04G 21/123; E04G 21/122
See application file for complete search history.

(56) References Cited

U.S. PATENT DOCUMENTS

2006/0283516 A1 12/2006 Nagaoka et al.
2009/0160373 A1* 6/2009 Katou ..... E04G 21/123 318/17
2010/0313991 A1 12/2010 Nagaoka et al.
2012/0118176 A1* 5/2012 Gregersen ..... B65B 13/22 100/2
2020/0254508 A1 8/2020 Yoshida et al.

FOREIGN PATENT DOCUMENTS

CN 214996121 U 12/2021
GB 2358154 A 7/2001
JP 2005-194847 A 7/2005
JP 2013227728 A * 11/2013
JP 2020-133129 A 8/2020

OTHER PUBLICATIONS

Translation of JP-2013227728 (JP 5929468B2).*
Feb. 7, 2024—(EP) Extended Search Report—EP App 23193857.2.

* cited by examiner

*Primary Examiner* — Bobby Yeonjin Kim
(74) *Attorney, Agent, or Firm* — Banner & Witcoff, Ltd.

(57) ABSTRACT

A binding machine includes a magazine configured to accommodate a wire, a wire feeding unit configured to feed the wire in a forward direction in which the wire is pulled out from the magazine and to the magazine, a drive unit configured to drive the wire feeding unit, a curl forming unit configured to form a path along which the wire fed in the forward direction is to be wound around an object, a binding unit configured to twist the wire fed in the reverse direction and wound on the object by the wire feeding unit, and a controller configured to control the drive unit. The controller is configured to change a feeding speed of the wire by controlling a rotational speed of the drive unit based on a state of the wire in the magazine.

14 Claims, 6 Drawing Sheets

FEEDING SPEED CONTROL FOR A BINDING MACHINE

CROSS-REFERENCE TO RELATED APPLICATIONS

The present application claims priority from Japanese Patent Application No. 2022-139996 filed on Sep. 2, 2022, the entire content of which is incorporated herein by reference.

TECHNICAL FIELD

The present invention relates to a binding machine configured to bind a to-be-bound object such as a reinforcing bar with a wire.

BACKGROUND ART

In the related art, suggested is a binding machine referred to as a reinforcing bar binding machine that binds two or more reinforcing bars with a wire by winding the wire around the two or more reinforcing bars and twisting the wire wound on the reinforcing bars.

A reinforcing bar binding machine in the related art has a configuration in which a wire is fed with a wire feeding unit, wound around a reinforcing bar, and then twisted to bind the reinforcing bar. Regarding such a reinforcing bar binding machine, suggested is a reinforcing bar binding machine that feeds a wire in a forward direction, winds the wire around a reinforcing bar, feeds the wire in a reverse direction, winds the wire on the reinforcing bar, cuts the wire, and twists a place where one end portion side and the other end portion side of the wire intersect to bind a reinforcing bar (for example, refer to JP2020-133129A).

By increasing a rotational speed of a feeding motor for feeding a wire, a speed for feeding the wire increases, so a reduction in time necessary for one operation of binding a reinforcing bar can be expected. On the other hand, a load that is applied to the wire increases, depending on a state of the wire accommodated in a magazine. When the rotational speed of the feeding motor is increased in a state where the load applied to the wire is high, slippage occurs between a feeding gear driven by the feeding motor and the wire, so there is a possibility that a predetermined amount of wire required to bind the reinforcing bar cannot be fed.

The present invention has been made in view of the above problem, and an object thereof is to provide a binding machine capable of setting a wire feeding speed according to a state of a wire.

SUMMARY

According to an aspect of the invention, a binding machine includes a magazine configured to accommodate a wire, a wire feeding unit configured to feed the wire in a forward direction in which the wire is pulled out from the magazine and in a reverse direction in which the wire is pulled back to the magazine, a drive unit configured to drive the wire feeding unit, a curl forming unit configured to form a path along which the wire fed in the forward direction by the wire feeding unit is to be wound around an object, a binding unit configured to twist the wire fed in the reverse direction and wound on the object by the wire feeding unit, and a controller configured to control the drive unit. The controller is configured to change a feeding speed of the wire by controlling a rotational speed of the drive unit based on a state of the wire in the magazine. The controller is also configured to rotate the drive unit at a first rotation speed or a second rotation speed which is lower than the first rotation speed based on a state of the wire in the magazine.

In the present invention, when a state of the wire in the magazine is such that even when the speed at which the wire is fed with the wire feeding unit is increased, the wire can be fed normally, the rotational speed of the first drive unit is increased.

According to the present invention, the rotational speed of the first drive unit is controlled based on the state of the wire in the magazine, so that the wire feeding speed can be changed so that the wire is normally fed with the wire feeding unit.

DESCRIPTION OF EMBODIMENTS

Hereinafter, an example of a reinforcing bar binding machine as an embodiment of the binding machine of the present invention will be described with reference to the drawings.

Figure 1:
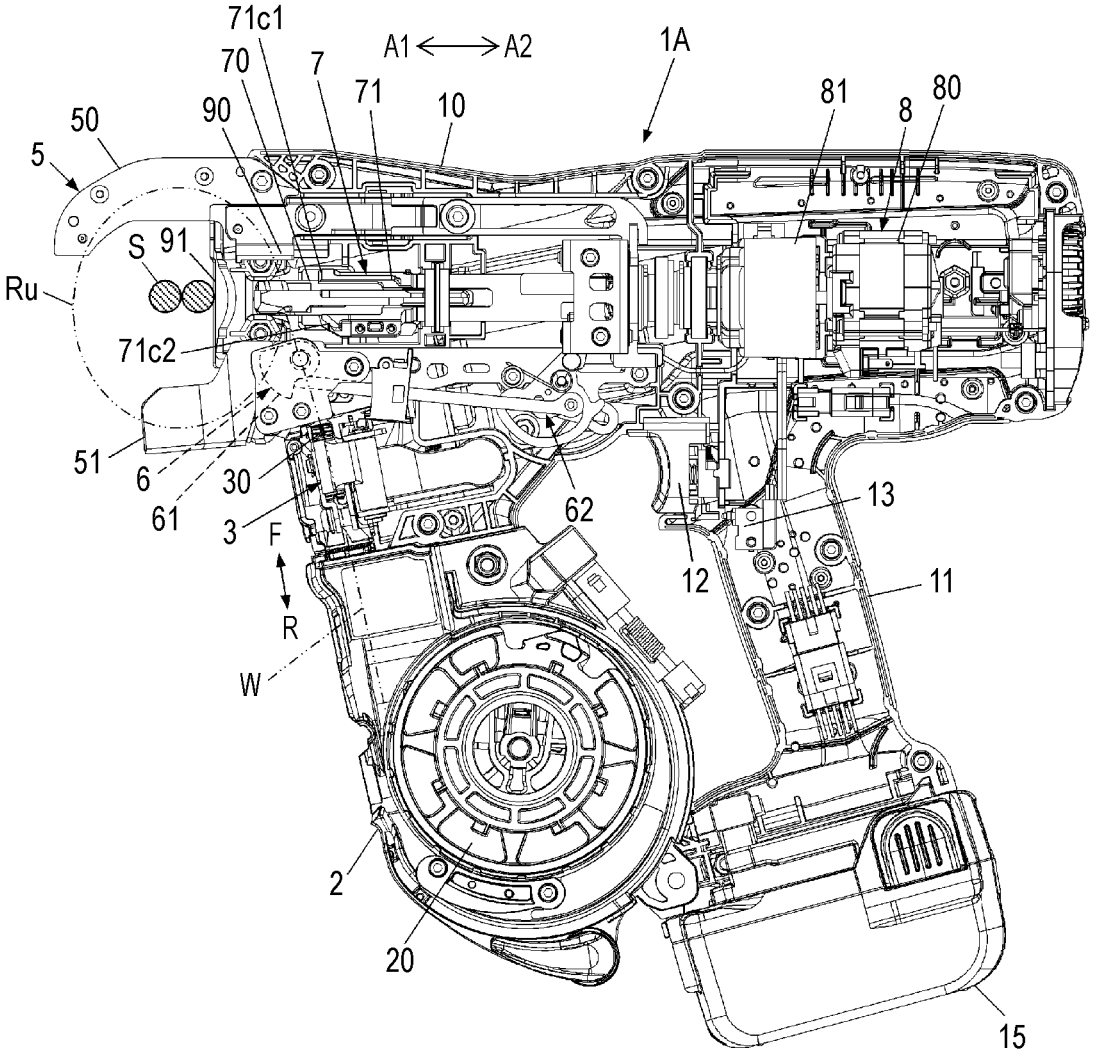
FIG. 1 is an internal configuration view showing an example of an overall configuration of a reinforcing bar binding machine of a first embodiment, as seen from a side.
Figure 2:
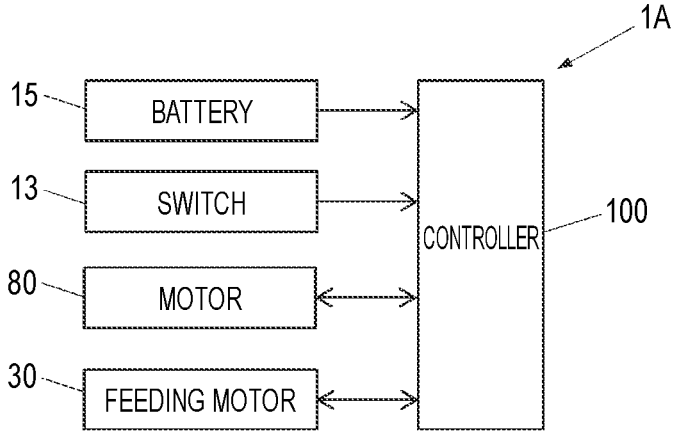
FIG. 2 is a block diagram showing an example of a control function of the reinforcing bar binding machine according to the present embodiment.

Configuration Example of Reinforcing Bar Binding Machine of Present Embodiment FIG. 1 is an internal configuration view showing an example of an overall configuration of a reinforcing bar binding machine of the present embodiment, as seen from a side, and FIG. 2 is a block diagram showing an example of a control function of the reinforcing bar binding machine of the present embodiment.

A reinforcing bar binding machine 1A feeds a wire W in a forward direction denoted with an arrow F, winds the wire around reinforcing bars S, which are a to-be-bound object, feeds the wire W wound around the reinforcing bars S in a reverse direction denoted with an arrow R, winds the wire on the reinforcing bars S, cuts the wire, and then twists the wire W to bind the reinforcing bars S with the wire W.

The reinforcing bar binding machine 1A includes a magazine 2 in which the wire W is accommodated, and a wire feeding unit 3 that feeds the wire W, so as to implement the above-described functions. In addition, the reinforcing bar binding machine 1A includes a curl forming unit 5 that forms a path along which the wire W fed by the wire feeding unit 3 is to be wound around the reinforcing bars S, and a cutting unit 6 that cuts the wire W wound on the reinforcing bars S. In addition, the reinforcing bar binding machine 1A includes a binding unit 7 that twists the wire W wound on the reinforcing bars S, and a drive unit 8 that drives the binding unit 7.

Further, the reinforcing bar binding machine 1A has such a form that an operator grips and uses with a hand, and has a main body part 10 and a handle part 11.

The magazine 2 is an example of the accommodation unit, and a reel 20 on which the long wire W is wound to be reeled out is rotatably and detachably accommodated therein. For the wire W, a wire made of a plastically deformable metal wire, a wire having a metal wire covered with a resin, or a twisted wire is used.

In a configuration in which the reinforcing bars S are bound with one wire W, one wire W is wound on a hub part (not shown) of the reel 20, and one wire W can be pulled out while the reel 20 rotates. In addition, in a configuration in which the reinforcing bars S are bound with a plurality of wires W, the plurality of wires W are wound on the hub part, and the plurality of wires W can be pulled out at the same time while the reel 20 rotates. For example, in a configuration in which the reinforcing bars S are bound with two wires W, the two wires W are wound on the hub part, and the two wires W can be pulled out at the same time while the reel 20 rotates. Note that when there is slack in the wire W wound on the reel 20, the wire W is pulled out without the reel 20 rotating until the slack is eliminated.

The wire feeding unit 3 includes a pair of feeding gears 30 that sandwiches and feeds the wire W. The wire feed unit 3 is configured such that a rotating operation of a feeding motor 31 as a first drive unit shown in FIG. 2 is transmitted to rotate the feeding gears 30. Thereby, the wire feeding unit 3 feeds the wire W sandwiched between the pair of feeding gears 30 along an extension direction of the wire W. In a configuration in which a plurality of, for example, two wires W are fed to bind the reinforcing bars S, the two wires W are fed aligned in parallel.

The wire feeding unit 3 is configured such that a rotation direction of the feeding motor 31 is switched between forward and reverse directions to switch rotation directions of the feeding gears 30, thereby feeding the wire W in the forward direction denoted with the arrow F, feeding the wire W in the reverse direction denoted with the arrow R, or switching the feeding direction of the wire W between the forward and reverse directions.

The curl forming unit 5 includes a curl guide 50 that curls the wire W fed by the wire feeding unit 3, and an induction guide 51 that guides the wire W curled by the curl guide 50 toward the binding unit 7. In the reinforcing bar binding machine 1A, the path of the wire W that is fed by the wire feeding unit 3 is regulated by the curl forming unit 5, so that a locus of the wire W becomes a loop Ru as shown with a dashed-two dotted line in FIG. 1 and the wire W is thus wound around the reinforcing bars S.

The cutting unit 6 includes a movable blade part 61, and a transmission mechanism 62 that transmits an operation of the binding unit 7 to the movable blade part 61. The cutting unit 6 cuts the wire W by a rotating operation of the movable blade part 61 about a fixed blade part (not shown) as a fulcrum shaft. The transmission mechanism 62 is configured by a cam, a link, and the like.

The binding unit 7 includes a wire locking body 70 to which the wire W is locked. A detailed embodiment of the binding unit 7 will be described below. The drive unit 8 includes a motor 80 as a second drive unit, and a decelerator 81 that performs deceleration and amplification of torque.

The reinforcing bar binding machine 1A includes a feeding regulation part 90 against which a tip end of the wire W is butted, on a feeding path of the wire W that is locked by the wire locking body 70. In addition, in the reinforcing bar binding machine 1A, the curl guide 50 and the induction guide 51 of the curl forming unit 5 are provided at an end portion on a front side of the main body part 10. Further, in the reinforcing bar binding machine 1A, a butting portion 91 against which the reinforcing bars S are to be butted is provided at an end portion on the front side of the main body part 10 and between the curl guide 50 and the induction guide 51.

Further, in the reinforcing bar binding machine 1A, the handle part 11 extends downward from the main body part 10. In addition, a battery 15 is detachably mounted to a lower part of the handle part 11. In addition, in the reinforcing bar binding machine 1A, the magazine 2 is provided in front of the handle part 11.

In the reinforcing bar binding machine 1A, a trigger 12 is provided on a front side of the handle part 11, and a switch 13 is provided inside the handle part 11. In the reinforcing bar binding machine 1A, a controller 100 controls the feeding motor 31 and the motor 80, in response to a state of the switch 13 that is pressed by an operation on the trigger 12.

Figure 3A:
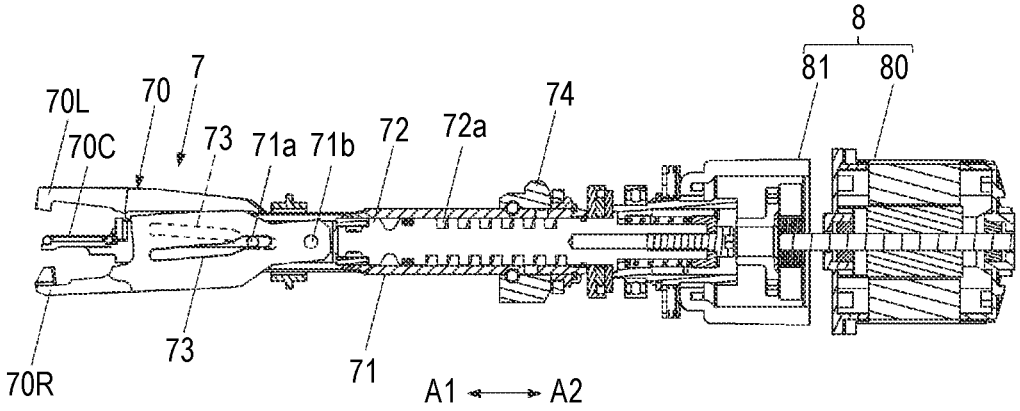
FIG. 3A is a sectional plan view showing an example of a binding unit.
Figure 3B:
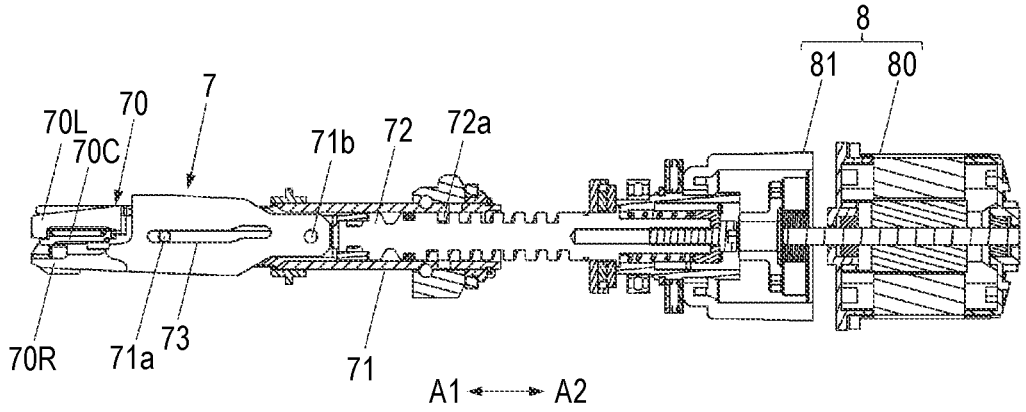
FIG. 3B is a sectional plan view showing the example of the binding unit.

FIGS. 3A and 3B are sectional plan views showing an example of the binding unit. Next, a configuration of the binding unit will be described with reference to each drawing.

The binding unit 7 includes a rotary shaft 72 that actuates the wire locking body 70 and a sleeve 71. The binding unit 7 and the drive unit 8 are configured such that the rotary shaft 72 and the motor 80 are connected via the decelerator 81 and the rotary shaft 72 is driven by the motor 80 via the decelerator 81.

The wire locking body 70 includes a center hook 70C connected to the rotary shaft 72, and a first side hook 70R and a second side hook 70L that open/close with respect to the center hook 70C.

The center hook 70C is connected to a tip end of the rotary shaft 72, which is one end portion along an axis direction of the rotary shaft 72, via a configuration that can rotate with respect to the rotary shaft 72 and move in the axis direction integrally with the rotary shaft 72.

The wire locking body 70 opens/closes in directions in which the tip end side of the first side hook 70R is contacted/separated with respect to the center hook 70C by a rotating operation about a shaft 71*b* as a fulcrum. The wire locking body also opens/closes in directions in which the tip end side of the second side hook 70L is contacted/separated with respect to the center hook 70C.

The sleeve 71 has a convex portion (not shown) protruding from an inner circumferential surface of a space in which the rotary shaft 72 is inserted, and the convex portion enters a groove portion of a feeding screw 72*a* formed along the axis direction on an outer circumference of the rotary shaft 72. When the rotary shaft 72 rotates, the sleeve 71 moves in a direction along the axis direction of the rotary shaft 72, according to a rotation direction of the rotary shaft 72 by an action of the convex portion (not shown) and the feeding screw 72*a* of the rotary shaft 72. The sleeve 71 also rotates integrally with the rotary shaft 72.

The sleeve 71 has an opening/closing pin 71*a* that opens/closes the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending along a moving direction of the sleeve 71 and converting a linear motion of the opening/closing pin 71*a* that moves in conjunction with the sleeve 71 into an opening/closing operation by rotation of the first side hook 70R and the second side hook 70L about the shaft 71*b* as a fulcrum.

The wire locking body 70 is configured such that, when the sleeve 71 is moved in a direction of an arrow A2, the first side hook 70R and the second side hook 70L are moved away from the center hook 70C by the rotating operation about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W passes is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3 passes between the center hook 70C and the first side hook 70R. The wire W passing between the center hook 70C and the first side hook 70R is guided to the curl forming unit 5. Then, the wire W curled by the curl forming unit 5 and guided to the binding unit 7 passes between the center hook 70C and the second side hook 70L.

The wire locking body 70 is configured such that, when the sleeve 71 is moved in a direction of an arrow A1, the first side hook 70R and the second side hook 70L are moved toward the center hook 70C by the rotating operation about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is locked in such an aspect that the wire can move between the first side hook 70R and the center hook 70C. In addition, when the second side hook 70L is closed with respect to the center hook 70C, the wire W sandwiched between the second side hook 70L and the center hook 70C is locked in such an aspect that the wire does not come off between the second side hook 70L and the center hook 70C.

The sleeve 71 has a bending portion 71*c*1 that pushes and bends a tip end side (one end portion) of the wire W in a predetermined direction to form the wire W into a predetermined shape, and a bending portion 71*c*2 that pushes and bends a terminal end side (other end portion) of the wire W cut by the cutting unit 6 in a predetermined direction to form the wire W into a predetermined shape.

The sleeve 71 is moved in the direction of the arrow A1, so that the tip end side of the wire W locked by the center hook 70C and the second side hook 70L is pushed and bent toward the reinforcing bars S by the bending portion 71*c*1. In addition, the sleeve 71 is moved in the direction of the arrow A1, so that the terminal end side of the wire W locked by the center hook 70C and the first side hook 70R and cut by the cutting unit 6 is pushed and bent toward the reinforcing bars S by the bending portion 71*c*2.

The binding unit 7 includes a rotation regulation part 74 that regulates rotations of the wire locking body 70 and the sleeve 71 that are rotated in conjunction with the rotating operation of the rotary shaft 72. In the binding part 7, the rotation regulation part 74 regulates rotation of the sleeve 71 that is rotated in conjunction with rotation of the rotary shaft 72, according to a position of the sleeve 71 along an axial position of the rotary shaft 72, so that the sleeve 71 is moved in the direction of the arrow A1 and the direction of the arrow A2 by the rotating operation of the rotary shaft 72.

Thereby, the sleeve 71 moves in the direction of the arrow A1 without rotating, so that the first side hook 70R and the second side hook 70L are closed with respect to the center hook 70C, and the wire W is locked. In addition, the sleeve 71 moves in the direction of the arrow A2 without rotating, so that the first side hook 70R and the second side hook 70L are opened with respect to the center hook 70C, and the locking of the wire W is released.

The binding unit 7 is configured such that when the rotation regulation on the sleeve 71 by the rotation regulation part 74 is released, the sleeve 71 is rotated in conjunction with the rotation of the rotary shaft 72.

Thereby, the first side hook 70R and second side hook 70L and the center hook 70C locking the wire W are rotated to twist the locked wire W.

Figure 4:
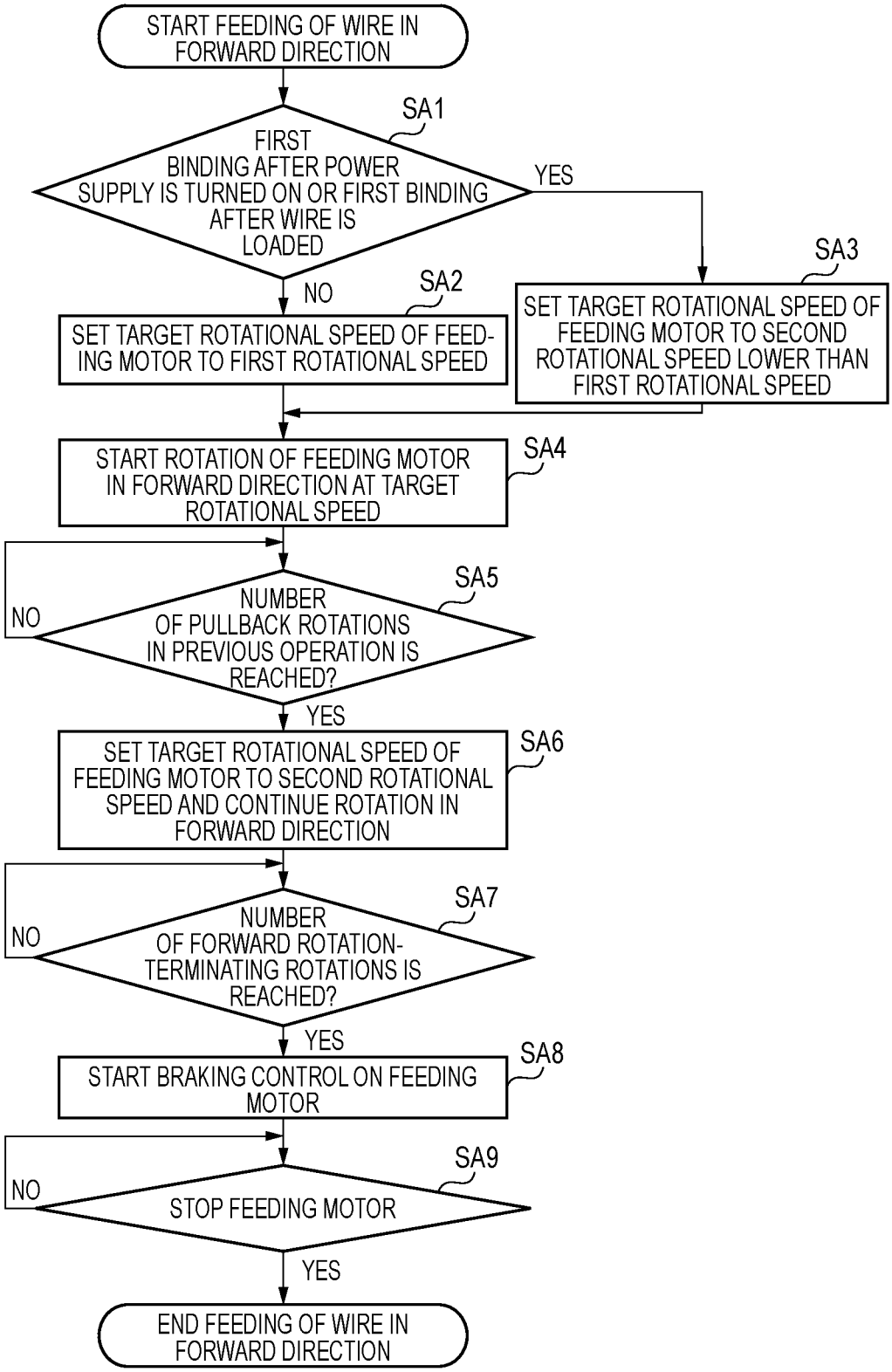
FIG. 4 is a flowchart showing an example of an operation of feeding a wire in a forward direction.
Figure 5:
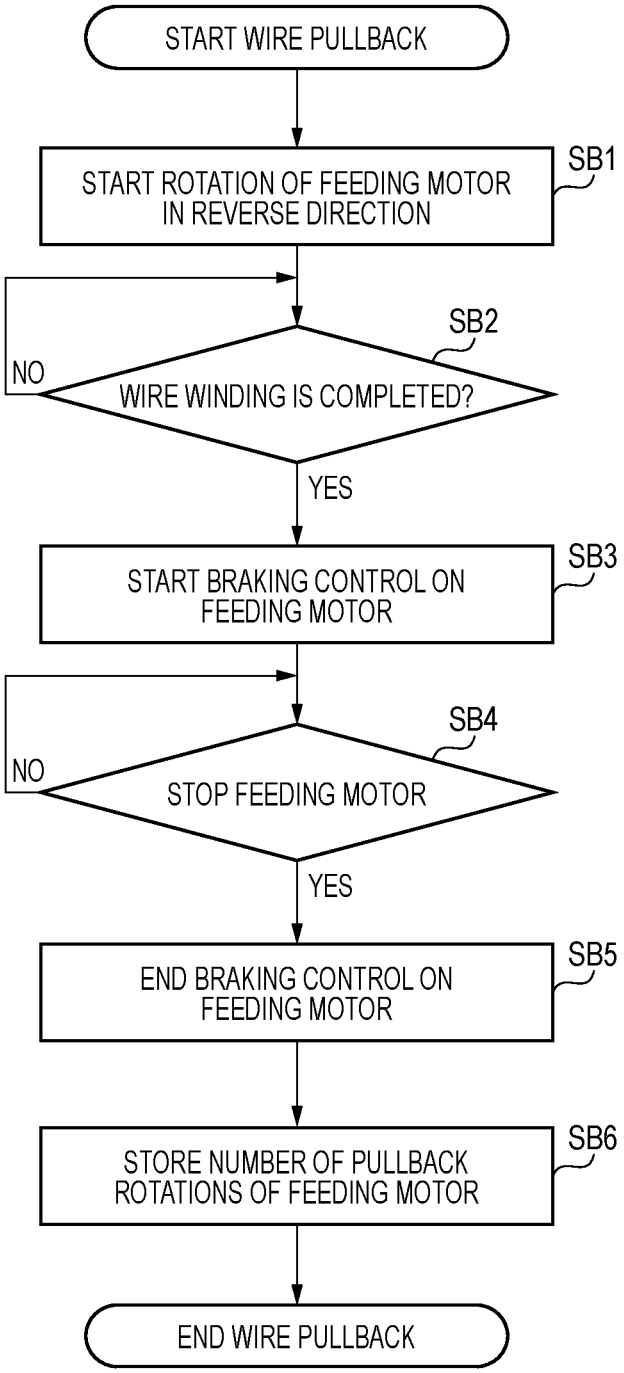
FIG. 5 is a flowchart showing an example of an operation of feeding the wire in a reverse direction.

Example of Operation of Reinforcing Bar Binding Machine of Present Embodiment FIG. 4 is a flowchart showing an example of an operation of feeding a wire in a forward direction, and FIG. 5 is a flowchart showing an example of an operation of feeding a wire in a reverse direction. Subsequently, the operation of binding the reinforcing bars S with the wire W by the reinforcing bar binding machine 1A of the present embodiment will be described with reference to each drawing.

The reinforcing bar binding machine 1A is in a standby state where the wire W is sandwiched between the pair of feeding gears 30 and the tip end of the wire W is located between a sandwiched position by the feeding gears 30 and the cutting unit 6. In addition, in the reinforcing bar binding machine 1A, in the standby state, as shown in FIG. 3A and the like, the first side hook 70R is opened with respect to the center hook 70C, and the second side hook 70L is opened with respect to the center hook 70C.

When the reinforcing bars S are inserted between the curl guide 50 and the induction guide 51 of the curl forming unit 5 and the switch 13 is pressed by operating the trigger 12, the controller 100 determines in step SA1 of FIG. 4 whether the binding operation is a first binding operation after the power supply is turned on or a first binding operation after the wire W is loaded into the magazine 2.

If the binding operation is neither a first binding operation after the power supply is turned on nor a first binding operation after the wire W is loaded into the magazine 2, slack has occurred in the wire W wound on the reel 20 when the wire W has been pulled back in order to wind the wire W on the reinforcing bars S in a previous binding operation. In this case, when the wire W is fed next in the forward direction, the wire W is pulled out without the reel 20 rotating until the slack in the wire W is eliminated. Thereby, the load for feeding the wire W in the forward direction is lowered, as compared with a case where the reel 20 is rotated.

Therefore, when the binding operation is neither a first binding operation after the power supply is turned on nor a first binding operation after the wire W is loaded into the magazine 2 and slack, which is sufficient to allow the wire W to be pulled out without the reel rotating in the operation of feeding the wire W in the forward direction, has occurred in the wire W wound on the reel 20, a target rotational speed in the forward direction of the feeding motor 31 is set to a first rotational speed in step SA2 of FIG. 4.

In contrast, when the binding operation is a first binding operation after the power supply is turned on, or a first binding operation after the wire W is loaded into the magazine 2, there is a possibility that some loosening has occurred in the wire W wound on the reel 20 due to elasticity of the wire W, or the like. However, there is a case where slack, which is sufficient to allow the wire W to be pulled out without the reel 20 rotating in the operation of feeding the wire W in the forward direction, has occurred in the wire W wound on the reel 20. In this case, when the wire W is fed in the forward direction, the reel 20 may rotate following the feeding of the wire W. In this case, the load for feeding the wire W in the forward direction becomes higher, as compared with a case where the reel 20 does not rotate.

Therefore, when the binding operation is a first binding operation after the power supply is turned on, or a first binding operation after the wire W is loaded into the magazine 2, the target rotational speed in the forward direction of the feeding motor 31 is set to a second rotational speed lower than the first rotational speed, in step SA3 of FIG. 4.

When the switch 13 is pressed by operating the trigger 12 and the target rotational speed of the feeding motor 31 is set, the controller 100 drives the feeding motor 31 in the forward rotation direction at the set target rotational speed in step SA4 of FIG. 4, and feeds the wire W in the forward direction indicated with the arrow F by the feeding unit 3.

In a configuration where a plurality of, for example, two wires W are fed, the two wire W are fed aligned in parallel along an axis direction of the loop Ru formed by the wires W.

The controller 100 determines whether the number of rotations of the feeding motor 31 after starting the driving in the forward rotation direction of the feeding motor 31 has reached a number of pullback rotations at the time of reversely rotating the feeding motor 31 in a previous pullback operation of the wire W, in step SA5 of FIG. 4. When the number of rotations of the feeding motor 31 reaches the number of pullback rotations in the previous operation, the slack in the wire W wound on the reel 20 is eliminated. For this reason, when the wire W is further fed in the forward direction, the reel 20 rotates following the feeding of the wire W.

Therefore, when the number of rotations of the feeding motor 31 reaches the number of pullback rotations in the previous operation, as pullback information about feeding of the wire W in the reverse direction in the previous binding operation, which is information for controlling the rotational speed of the feeding motor 31, the controller 100 sets the target rotational speed in the forward direction of the feeding motor 31 to the second rotational speed in step SA6 of FIG. 4, and continues to drive the feeding motor 31 in the forward rotation direction.

The wire W fed in the forward direction passes between the center hook 70C and the first side hook 70R, and is then fed to the curl guide 50 of the curl forming unit 5. The wire W passes through the curl guide 50 and is thus curled to be wound around the reinforcing bars S.

The wire W curled by the curl guide 50 is guided to the induction guide 51 and is further fed in the forward direction by the wire feeding unit 3, so that the wire is guided between the center hook 70C and the second side hook 70L by the induction guide 51. Then, the wire W is fed until the tip end is butted against the feeding regulation part 90.

When it is determined in step SA7 of FIG. 4 that the number of rotations in the forward direction of the feeding motor 31 has reached a number of forward rotation-terminating rotations at which the tip end of the wire W is fed to a position where the tip end of the wire is butted against the feeding regulation part 90, the controller 100 performs braking control of stopping the rotation of the feeding motor 31 in step SA8. When it is determined in step SA9 that the feeding motor 31 has stopped, the controller 100 ends the braking control on the feeding motor 31.

After stopping the feeding of the wire Win the forward direction, the controller 100 drives the motor 80 in the forward rotation direction. The rotation of the sleeve 71 that is rotated in conjunction with the rotation of the rotary shaft 72 is regulated by the rotation regulation part 74 in an operating region where the wire W is locked by the wire locking body 70. Thereby, the rotation of the motor 80 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, the first side hook 70R is moved toward the center hook 70C by the rotating operation about the shaft 71*b* as a fulcrum. When the first side hook 70R is closed with respect to the center hook 70C, the wire W sandwiched between the first side hook 70R and the center hook 70C is locked in such an aspect that the wire can move between the first side hook 70R and the center hook 70C.

In addition, the second side hook 70L is moved toward the center hook 70C by the rotating operation about the shaft 71*b* as a fulcrum. When the second side hook 70L is closed with respect to the center hook 70C, the wire W sandwiched between the second side hook 70L and the center hook 70C is locked in such an aspect that the wire does not come off between the second side hook 70L and the center hook 70C.

As shown in FIG. 3B, after advancing the sleeve 71 to a position where the wire W is locked in the closing operation of the first side hook 70R and the second side hook 70L, the controller 100 temporarily stops the rotation of the motor 80, and drives the feeding motor 31 in the reverse rotation direction in step SB1 of FIG. 5.

Thereby, the pair of feeding gears 30 is reversely rotated and the wire W sandwiched between the pair of feeding gears 30 is fed in the reverse direction denoted with the arrow R. Since the tip end side of the wire W is locked in such an aspect that the wire does not come off between the second side hook 70L and the center hook 70C, the wire W is wound on the reinforcing bars S by the operation of feeding the wire W in the reverse direction.

When the wire W is wound on the reinforcing bars S in step SB2 of FIG. 5, so the current flowing through the feeding motor 31 continues to exceed a threshold value within a predetermined time due to an increase in load resulting from the wire W being no longer fed in the reverse direction, the controller 100 performs braking control of stopping the rotation of the feeding motor 31 in step SB3. When it is determined in step SB4 of FIG. 5 that the feeding motor 31 has stopped, the controller 100 ends the braking control on the feeding motor 31 in step SB5. Then, the controller 100 counts the number of rotations in the reverse direction of the feeding motor 31, and stores the same as the number of pullback rotations at the time of reversely rotating the feeding motor 31 in the pullback operation of the wire W, in step SB6 of FIG. 5.

When the controller 100 stops the driving in the reverse rotation direction of the feeding motor 31, the controller 100 drives the motor 80 in the forward rotation direction, thereby further moving the sleeve 71 in the forward direction denoted with the arrow A1. The movement of the sleeve 71 in the forward direction is transmitted to the cutting unit 6 by the transmission mechanism 62, so that the movable blade part 61 is actuated to cut the wire W locked by the first side hook 70R and the center hook 70C.

By driving the motor 80 in the forward rotation direction, the sleeve 71 is moved in the forward direction denoted with the arrow A1, so that the bent portions 71*c*1 and 71*c*2 are moved toward the reinforcing bars S almost simultaneously with the cutting of the wire W. Thereby, the tip end side of the wire W locked by the center hook 70C and the second side hook 70L is pressed toward the reinforcing bars S and bent toward the reinforcing bars S at the locking position as a fulcrum by the bending portion 71*c*1. The sleeve 71 is further moved in the forward direction, so that the wire W locked between the second side hook 70L and the center hook 70C is maintained sandwiched by the bending portion 71*c*1.

In addition, the terminal end side of the wire W locked by the center hook 70C and the first side hook 70R and cut by the cutting unit 6 is pressed toward the reinforcing bars S and bent toward the reinforcing bars S at the locking position as a fulcrum by the bending portion 71*c*2. The sleeve 71 is further moved in the forward direction, so that the wire W locked between the first side hook 70R and the center hook 70C is maintained sandwiched by the bending portion 71*c*2.

After the tip end side and the terminal end side of the wire W are bent toward the reinforcing bars S, the motor 80 is further driven in the forward rotation direction, so that the sleeve 71 is further moved in the forward direction. When the sleeve 71 is moved to a predetermined position, the rotation regulation on the sleeve 71 by the rotation regulation part 74 is released.

Thereby, the motor 80 is further driven in the forward rotation direction, so that the sleeve 71 is rotated in conjunction with the rotary shaft 72 and the wire W locked by the wire locking body 70 is twisted.

When it is detected that the load that is applied to the motor 80 is maximized as the wire W is twisted, the controller 100 stops the driving in the forward rotation direction of the motor 80, and then drives the motor 80 in the reverse rotation direction. When the motor 80 is driven in the reverse rotation direction, the rotary shaft 72 is reversely rotated and the sleeve 71 is reversely rotated in conjunction with the reverse rotation of the rotary shaft 72, the rotation of the sleeve 71 that is rotated in conjunction with the rotation of the rotary shaft 72 is regulated by the rotation regulation blade 74. Thereby, the sleeve 71 is moved in the direction of the arrow A2, which is a backward direction.

When the sleeve 71 is moved in the backward direction, the bending portions 71*c*1 and 71*c*2 are away from the wire W, and the holding of the wire W by the bending portions 71*c*1 and 71*c*2 is released. In addition, when the sleeve 71 is moved in the backward direction, the opening/closing pin 71*a* passes through the opening/closing guide holes 73. Thereby, the first side hook 70R is moved away from the center hook 70C by the rotating operation about the shaft 71*b* as a fulcrum. In addition, the second side hook 70L is moved away from the center hook 70C by the rotating operation about the shaft 71*b* as a fulcrum.

Thereby, the wire W comes off from the wire locking body 70.

Example of Operational Effects of Reinforcing Bar Binding Machine of Present Embodiment By increasing the rotational speed of the feeding motor 31, a speed for feeding the wire W increases, so a reduction in time necessary for one operation of binding the reinforcing bars S can be expected. On the other hand, in the operation of feeding the wire W in the forward direction, in a state where the reel 20 rotates following the feeding of the wire W, the load that is applied to the wire W increases. When the rotational speed of the feeding motor 31 is increased in a state where the load that is applied to the wire W is high, slippage occurs between the feeding gears 30 and the wire W, so there is a possibility that a predetermined amount of wire W required to bind the reinforcing bars S cannot be fed.

Therefore, the rotational speed of the feeding motor 31 is switched according to the state of the wire Win the magazine 2. The controller 100 determines the state of the wire Win the magazine 2, based on the presence or absence of the previous binding operation that has not undergone OFF and ON processes of the power supply and replacement of the reel 20.

As described above, when the previous binding operation is being performed, slack has occurred in the wire Win the magazine 2 due to the operation of pulling back the wire W in the previous binding operation. For this reason, when the wire W is fed next in the forward direction, the wire W is pulled out without the reel 20 rotating until the slack in the wire W is eliminated. Thereby, the load for feeding the wire W in the forward direction is lowered, as compared with a case where the reel 20 is rotated.

Therefore, when the binding operation this time is neither a first binding operation after the power supply is turned on nor a first binding operation after the wire W is loaded into the magazine 2, i.e., when the previous binding operation is being carried out, the target rotational speed in the forward direction of the feeding motor 31 is set to the first rotational speed higher than the second rotational speed. Then, the wire W is fed in the forward direction by rotating the feeding motor 31 at the first rotational speed.

When the state of the wire W in the magazine 2 is such that the load applied to the wire W is low, even if the rotational speed of the feeding motor 31 is increased, slippage between the feeding gears 30 and the wire W is suppressed, and a predetermined amount of wire W can be fed at an increased feeding speed of the wire W.

However, if the wire W is fed in the forward direction until the slack in the wire W wound on the reel 20 is eliminated, the reel 20 rotates following the feeding of the wire W by further feeding the wire W in the forward direction. The number of rotations of the feeding motor 31 until the slack in the wire W wound on the reel 20 is eliminated depends on the number of rotations of the feeding motor 31 at the time of pulling back the wire W in the previous binding operation.

Therefore, the controller 100 determines whether the number of rotations of the feeding motor 31 after starting the driving in the forward rotation direction of the feeding motor 31 has reached the number of pullback rotations at the time of reversely rotating the feeding motor 31 in the previous pullback operation of the wire W. When the number of rotations of the feeding motor 31 reaches the number of pullback rotations in the previous operation, the controller 100 sets the target rotational speed in the forward direction of the feeding motor 31 to the second rotational speed, and continues to drive the feeding motor 31 in the forward rotation direction, thereby feeding the wire W in the forward direction.

Note that when the target rotational speed in the forward direction of the feeding motor 31 is switched from the first rotational speed to the second rotational speed, the rotational speed of the feeding motor 31 is not switched without a time lag. Thereby, even if the number of rotations of the feeding motor 31 reaches the number of pullback rotations in the previous operation and the target rotational speed in the forward direction of the feeding motor 31 is switched from the first rotational speed to the second rotational speed, the rotational speed of the feeding motor 31 is not immediately dropped from the first rotational speed to the second rotational speed. Therefore, in a next operation of feeding the wire W in the forward direction, the target rotational speed may be switched from the first rotational speed to the second rotational speed based on the number of pullback rotations in the previous operation so that the target rotational speed in the forward direction of the feeding motor 31 has been dropped from the first rotational speed to the second rotational speed at the timing when the number of rotations of the feeding motor 31 has reached the number of pullback rotations in the previous operation.

In contrast, in the case where there is no braking mechanism for stopping the rotation of the reel 20, as in the reinforcing bar binding machine 1A, after feeding the wire W in the forward direction and winding the wire around the reinforcing bars S, even when the rotation of the feeding gears 30 is stopped by the braking operation of the feeding motor 31, the reel 20 rotates by inertia, and slack occurs in the wire W. For this reason, when the wire W is fed next in the reverse direction, the wire W of a sum of a length of the wire W fed in the reverse direction and a length of the wire previously sent out due to the inertial rotation of the reel 20 is in a slack state.

Thereby, in the next operation of feeding the wire Win the forward direction, when the number of rotations of the feeding motor 31 reaches the number of pullback rotations in the previous operation, there remains extra slack where the wire W is pulled out without the reel 20 rotating. Therefore, even if the rotational speed of the feeding motor 31 is not immediately dropped from the first rotational speed to the second rotational speed, the wire W is fed without the reel 20 rotating, and the load that is applied to the feeding gears 30 or the like is suppressed from rapidly increasing.

On the other hand, in the case where a braking mechanism for stopping the rotation of the reel 20 is provided, after feeding the wire W in the forward direction and winding the wire around the reinforcing bars S, when the rotation of the reel 20 is stopped by the braking operation of the reel 20, the reel 20 does not rotate by inertia, and no slack occurs in the wire W. For this reason, when the wire W is fed next in the reverse direction, the wire W of the same length as the wire W was fed in the reverse direction is in a slack state.

Thereby, in the next operation of feeding the wire Win the forward direction, when the number of rotations of the feeding motor 31 reaches the number of pullback rotations in the previous operation, extra slack where the wire W is pulled out without the reel 20 rotating does not remain.

Therefore, when a braking mechanism for stopping the rotation of the reel 20 is provided, considering the extra slack where the wire W is pulled out without the reel 20 rotating, the target rotational speed in the forward direction of the feeding motor 31 may be switched from the first rotational speed to the second rotational speed based on the number of pullback rotations in the previous operation. In addition, when switching the target rotational speed in the forward direction of the feeding motor 31 from the first rotational speed to the second rotational speed, control to shorten the time lag caused by the switching of the rotational speed may be performed.

When the state of the wire W in the magazine 2 becomes from a low state of the load applied to the wire W to a high state, the rotational speed of the feeding motor 31 is lowered to suppress slippage between the feeding gears 30 and the wire W, so a predetermined amount of wire W can be fed.

In contrast, if the previous binding operation that has not undergone OFF and ON processes of the power supply and replacement of the reel 20 has not been performed, since the operation of pulling back the wire W has not been performed, slack, which is sufficient to allow the wire W to be pulled out without the reel 20 rotating in the operation of feeding the wire W in the forward direction, has not occurred in the wire W in the magazine 2. For this reason, when the wire W is fed in the forward direction, the reel 20 rotates following the feeding of the wire W. Thereby, the load for feeding the wire W in the forward direction becomes higher, as compared with a case where the reel 20 does not rotate.

Therefore, when the binding operation is a first binding operation after the power supply is turned on or a first binding operation after the wire W is loaded into the magazine 2, i.e., when the previous binding operation has not been carried out, the target rotational speed in the forward direction of the feeding motor 31 is set to the second rotational speed lower than the first rotational speed. Then, the wire W is fed in the forward direction by rotating the feeding motor 31 at the second rotational speed.

When the state of the wire W in the magazine 2 is such that the load applied to the wire W is high, the rotational speed of the feeding motor 31 is lowered to suppress slippage between the feeding gears 30 and the wire W, so a predetermined amount of wire W can be fed.

Therefore, it is possible to set the rotational speed of the feeding motor 31 suitable for the state of the wire W in the magazine 2, and when the state of the wire W in the magazine 2 is such that the load applied to the wire W is low, the rotational speed of the feeding motor 31 is increased to the first rotational speed, thereby shortening the time necessary for one operation of binding the reinforcing bars S. In addition, when the state of the wire W in the magazine 2 is such that the load applied to the wire W is high, the rotational speed of the feeding motor 2 is lowered to suppress slippage between the feeding gears 30 and the wire W, so a predetermined amount of wire W can be fed.

Figure 6A:
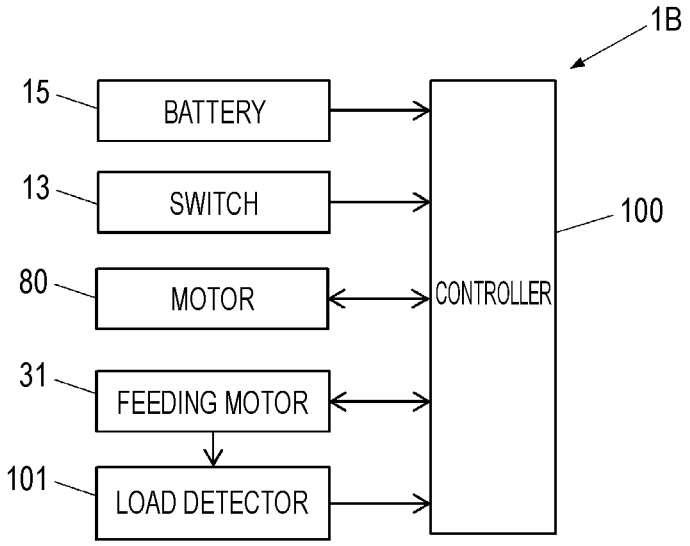
FIG. 6A is a block diagram showing an example of a control function of a reinforcing bar binding machine according to a modified embodiment of the present embodiment.
Figure 6B:
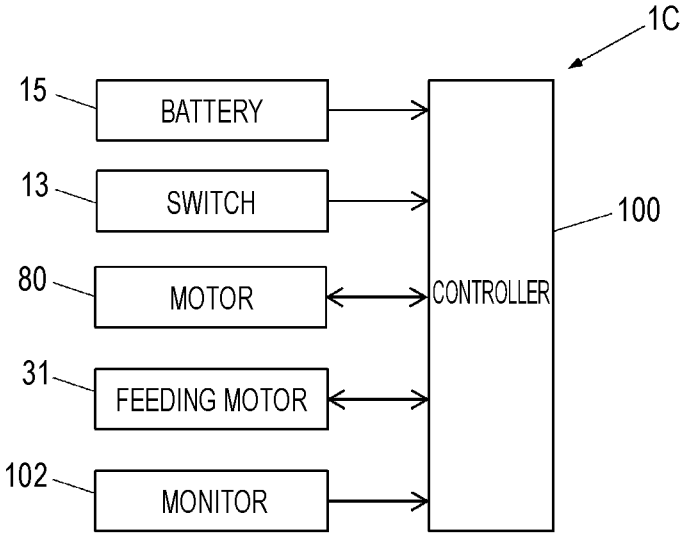
FIG. 6B is a block diagram showing an example of a control function of the reinforcing bar binding machine according to a modified embodiment of the present embodiment.
Figure 6C:
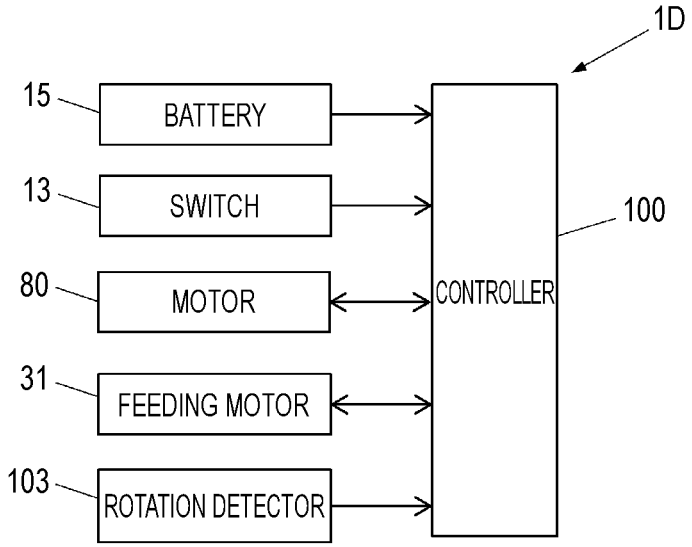
FIG. 6C is a block diagram showing an example of a control function of the reinforcing bar binding machine according to a modified embodiment of the present embodiment.

Modified Embodiments of Reinforcing Bar Binding Machine of Present Embodiment FIGS. 6A, 6B, and 6C are block diagrams showing an example of a control function of a reinforcing bar binding machine according to modified embodiments of the present embodiment. A reinforcing bar binding machine 1B shown in FIG. 6A includes a load detector 101 that detects a load applied to the feeding motor 31. The load detector 101 detects load variations applied to the feeding motor 31 based on the current flowing through the feeding gears 30, and the like. Note that the load detector 101 detects the load applied to the feeding gears 30 by detecting the load of the feeding motor 31.

When the rotation in the forward direction of the feeding motor 31 is started, the controller 100 detects the load applied to the feeding motor 31 by the load detector 101. When the load applied to the feeding motor 31 detected by the load detector 101 is equal to or less than a predetermined threshold value, the controller 100 sets the target rotational speed in the forward direction of the feeding motor 31 to the first rotational speed higher than the second rotational speed. Then, the wire W is fed in the forward direction by rotating the feeding motor 31 at the first rotational speed.

In addition, when the load applied to the feeding motor 31 detected by the load detector 101 exceeds the predetermined threshold value in a state in which the feeding motor 31 is rotated at the first rotational speed, the controller 100 sets the target rotational speed in the forward direction of the feeding motor 31 to the second rotational speed. Then, the wire W is fed in the forward direction by rotating the feeding motor 31 at the second rotational speed.

In contrast, when the rotation in the forward direction of the feeding motor 31 is started, the controller 100 detects the load applied to the feeding motor 31 by the load detector 101. When the load applied to the feeding motor 31 exceeds the predetermined threshold, the controller 100 sets the target rotational speed in the forward direction of the feeding motor 31 to the second rotational speed. Then, the wire W is fed in the forward direction by rotating the feeding motor 31 at the second rotational speed.

As described above, when the wire W is fed in the forward direction in a state in which the wire W in the magazine 2 is in slack, the wire W is pulled out without the reel 20 rotating until the slack in the wire W is eliminated. Therefore, the load applied to the feeding motor 31 is lowered. Thereby, by changing the rotational speed of the feeding motor 31 based on the variation of the load applied to the feeding motor 31, it is possible to set the rotational speed of the feeding motor 31 suitable for the state of the wire W in the magazine 2.

A reinforcing bar binding machine 1C shown in FIG. 6B includes a monitor 102 that monitors the state of the wire Win the magazine 2. The monitor 102 is configured by an optical sensor, a camera, and the like, and detects the presence or absence of slack in the wire W in the magazine 2, an amount of slack, and the like.

The controller 100 detects the presence or absence of slack in the wire Win the magazine 2, an amount of slack, and the like by the monitor 102 at a stage of starting the rotation in the forward direction of the feeding motor 3. When an amount of slack in the wire W detected by the monitor 102 exceeds a predetermined threshold value, the controller 100 sets the target rotational speed in the forward direction of the feeding motor 31 to the first rotational speed higher than the second rotational speed. Then, the wire W is fed in the forward direction by rotating the feeding motor 31 at the first rotational speed.

In addition, when the amount of slack in the wire W detected by the monitor 102 becomes equal to or less than the predetermined threshold value in a state in which the feeding motor 31 is rotated at the first rotational speed, the controller 100 sets the target rotational speed in the forward direction of the feeding motor 31 to the second rotational speed. Then, the wire W is fed in the forward direction by rotating the feeding motor 31 at the second rotational speed.

In contrast, the controller 100 detects the presence or absence of slack in the wire W in the magazine 2, an amount of slack, and the like by the monitor 102 at a stage of starting the rotation in the forward direction of the feeding motor 31. When the amount of slack in the wire W is equal to or less than the predetermined threshold value, the controller sets the target rotational speed in the forward direction of the feeding motor 31 to the second rotational speed. Then, the wire W is fed in the forward direction by rotating the feeding motor 31 at the second rotational speed.

As described above, when the wire W is fed in the forward direction in a state in which the wire W in the magazine 2 is in slack, the wire W is pulled out without the reel 20 rotating until the slack in the wire W is eliminated. Therefore, the load applied to the feeding motor 31 is lowered. Thereby, by changing the rotational speed of the feeding motor 31 based on the presence or absence of slack in the wire W in the magazine 2 and the amount of slack, it is possible to set the rotational speed of the feeding motor 31 suitable for the state of the wire W in the magazine 2.

A reinforcing bar binding machine 1D shown in FIG. 6C includes a rotation detector 103 that detects a behavior of rotation of the reel 20 in the magazine 2. The rotation detector 103 is configured by an optical sensor, a magnetic sensor, and the like, and detects whether the reel 20 is just before starting to rotate, whether the reel 20 is rotating, and the like, from a behavior of the reel 20 in the magazine 2.

The controller 100 sets the target rotational speed in the forward direction of the feeding motor 31 to the first rotational speed higher than the second rotational speed. Then, the wire W is fed in the forward direction by rotating the feeding motor 31 at the first rotational speed. When the feeding motor 31 starts to rotate in the forward direction, the controller 100 detects, from the behavior of the reel 20 in the magazine 2, whether the reel 20 is just before starting to rotate, whether the reel 20 is rotating, and the like by the rotation detector 103.

When the controller 100 detects that the reel 20 is just before starting to rotate from the behavior of the reel 20 detected by the rotation detector 103, the controller 100 sets the target rotational speed in the forward direction of the feeding motor 31 to the second rotational speed. Then, the wire W is fed in the forward direction by rotating the feeding motor 31 at the second rotational speed.

As described above, when the wire W is fed in the forward direction in a state in which the wire W in the magazine 2 is in slack, the wire W is pulled out without the reel 20 rotating until the slack in the wire W is eliminated. Therefore, the load applied to the feeding motor 31 is lowered. Thereby, by changing the rotational speed of the feeding motor 31 based on the behavior of rotation of the reel 20 in the magazine 2, it is possible to set the rotational speed of the feeding motor 31 suitable for the state of the wire W in the magazine 2.

Note that in the operation of feeding the wire Win the forward direction, the load applied just before the reel 20 starts to rotate increases, and when the reel 20 starts to rotate, the load decreases. Therefore, when the rotation of the reel 20 is detected by the rotation detector 103, the target rotational speed in the forward direction of the feeding motor 31 is set to the first rotational speed. Then, the wire W may be fed in the forward direction by rotating the feeding motor 31 at the first rotational speed.

In addition, when the wire W is fed in the forward direction in a state in which the wire W in the magazine 2 is in slack, and the slack in the wire W is eliminated, since a force pulling the wire W is applied to the reel 20 that has stopped rotating, there is a possibility that the wire W to be pulled out with the wire feeding unit 3 may bite into the wire W wound on the reel 20.

Therefore, when the controller 100 detects that the reel 20 is just before starting to rotate from the behavior of the reel 20 detected by the rotation detector 103, the controller 100 temporarily stops the driving of rotating the feeding motor 31 in the forward direction. This suppresses the force pulling the wire W from being applied to the reel 20 that has stopped rotating, thereby suppressing the wire W to be pulled out with the wire feeding unit 3 from biting into the wire W wound on the reel 20. The controller 100 temporarily stops the driving of rotating the feeding motor 31 in the forward direction, and then sets the target rotational speed in the forward direction of the feeding motor 31 to the second rotational speed. Then, the wire W is fed in the forward direction by rotating the feeding motor 31 at the second rotational speed.

Note that, in order to improve the accuracy of the timing for switching the rotational speed of the feeding motor 31, the controls using the load detector 101, the monitor 102, and the rotation detector 103 may be combined.

What is claimed is:

1. A binding machine comprising:

a magazine configured to accommodate a wire;

a wire feeding unit including a pair of feeding gears configured to feed the wire in a forward direction in which the wire is pulled out from the magazine and in a reverse direction in which the wire is pulled back to the magazine;

a drive unit configured to drive the wire feeding unit;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a controller configured to control the drive unit, wherein the controller is configured to change a feeding speed of the wire by controlling a rotational speed of the drive unit based on a state of the wire in the magazine, wherein the magazine is configured to accommodate a reel on which the wire is wound, wherein the controller is configured to control the rotational speed of the drive unit based on slack in the wire wound on the reel, and wherein the controller is configured to control the rotational speed of the drive unit based on pullback information about feeding of the wire in the reverse direction in a previous binding operation.

2. The binding machine according to claim 1, wherein the controller is configured to control the rotational speed of the drive unit based on whether OFF and ON process of a power supply or replacement of the reel has been done after a previous binding operation.

3. The binding machine according to claim 1, wherein the pullback information is based on a number of rotations of the drive unit in the feeding of the wire in the reverse direction in the previous binding operation.

4. The binding machine according to claim 1 further comprising a load detector configured to detect a load applied to the drive unit, wherein the controller is configured to control the rotational speed of the drive unit based on the load applied to the drive unit detected by the load detector.

5. A binding machine comprising:

a magazine configured to accommodate a wire;

a wire feeding unit including a pair of feeding gears configured to feed the wire in a forward direction in which the wire is pulled out from the magazine and in a reverse direction in which the wire is pulled back to the magazine;

a drive unit configured to drive the wire feeding unit;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a controller configured to control the drive unit, wherein the controller is configured to change a feeding speed of the wire by controlling a rotational speed of the drive unit based on a state of the wire in the magazine, wherein the magazine is configured to accommodate a reel on which the wire is wound, wherein the controller is configured to control the rotational speed of the drive unit based on slack in the wire wound on the reel, wherein the binding machine further comprises a monitor configured to monitor the state of the wire in the magazine, and wherein the controller is configured to control the rotational speed of the drive unit based on slack in the wire in the magazine detected by the monitor.

6. The binding machine according to claim 1 further comprising a rotation detector configured to detect a behavior of rotation of the reel in the magazine, wherein the controller is configured to control the rotational speed of the drive unit based on the behavior of rotation of the reel in the magazine detected by the rotation detector.

7. The binding machine according to claim 6, wherein the controller is configured to temporarily stop driving of the drive unit, when it is detected that the reel is just before starting to rotate based on the behavior of rotation of the reel in the magazine detected by the rotation detector.

8. A binding machine comprising:

a magazine configured to accommodate a wire;

a wire feeding unit including a pair of feeding gears configured to feed the wire in a forward direction in which the wire is pulled out from the magazine and in a reverse direction in which the wire is pulled back to the magazine;

a drive unit configured to drive the wire feeding unit;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a controller configured to control the drive unit, wherein the controller is configured to rotate the drive unit at a first rotation speed or a second rotation speed which is lower than the first rotation speed based on a state of the wire in the magazine, wherein the magazine is configured to accommodate a reel on which the wire is wound, wherein the controller is configured to set the rotational speed of the drive unit at the first rotation speed based on slack in the wire wound on the reel, and wherein, when the drive unit is rotating at the first rotation speed, the controller is configured to change the rotational speed of the drive unit from the first rotation speed to the second rotation speed based on pullback information about feeding of the wire in the reverse direction in a previous binding operation.

9. The binding machine according to claim 8, wherein the controller is configured to set the rotational speed of the drive unit at the first rotation speed in a case where OFF and ON process of a power supply or replacement of the reel has not been done after a previous binding operation.

10. The binding machine according to claim 8, wherein the pullback information is based on a number of rotations of the drive unit in the feeding of the wire in the reverse direction in the previous binding operation.

11. The binding machine according to claim 8 further comprising a load detector configured to detect a load applied to the drive unit, wherein the controller is configured to control the rotational speed of the drive unit based on the load applied to the drive unit detected by the load detector.

12. A binding machine comprising:

a magazine configured to accommodate a wire;

a wire feeding unit including a pair of feeding gears configured to feed the wire in a forward direction in which the wire is pulled out from the magazine and in a reverse direction in which the wire is pulled back to the magazine;

a drive unit configured to drive the wire feeding unit;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a controller configured to control the drive unit, wherein the controller is configured to rotate the drive unit at a first rotation speed or a second rotation speed which is lower than the first rotation speed based on a state of the wire in the magazine, wherein the magazine is configured to accommodate a reel on which the wire is wound, wherein the controller is configured to set the rotational speed of the drive unit at the first rotation speed based on slack in the wire wound on the reel, the binding machine further comprises a monitor configured to monitor the state of the wire in the magazine, and wherein the controller is configured to control the rotational speed of the drive unit based on slack in the wire in the magazine detected by the monitor.

13. The binding machine according to claim 8 further comprising a rotation detector configured to detect a behavior of rotation of the reel in the magazine, wherein the controller is configured to control the rotational speed of the drive unit based on the behavior of rotation of the reel in the magazine detected by the rotation detector.

14. The binding machine according to claim 13, wherein the controller is configured to temporarily stop driving of the drive unit, when it is detected that the reel is just before starting to rotate based on the behavior of rotation of the reel in the magazine detected by the rotation detector.

* * * * *